US005271205A

United States Patent [19]

Spatafora et al.

[11] Patent Number: 5,271,205

[45] Date of Patent: Dec. 21, 1993

[54] DEVICE FOR WRAPPING DISCOID COMMODITIES

[75] Inventors: Mario Spatafora; Antonio Gamberini, both of Bologna, Italy

[73] Assignee: G.D. Societa per Azioni, Bologna, Italy

[21] Appl. No.: 772,971

[22] Filed: Oct. 8, 1991

[30] Foreign Application Priority Data

Oct. 10, 1990 [IT] Italy ..... 3685 A/90
Jun. 20, 1991 [IT] Italy ..... B091 A 000216

[51] Int. Cl.[5] ..... B65B 11/54

[52] U.S. Cl. ..... 53/221; 53/225; 53/226; 53/372.9

[58] Field of Search ..... 53/221, 225, 226, 227, 53/216, 215, 372.9

[56] References Cited

U.S. PATENT DOCUMENTS

| | | | |
|---|---|---|---|
| 613,239 | 11/1898 | Burt | 53/216 X |
| 642,438 | 1/1900 | Fyfe | 53/216 X |
| 833,896 | 10/1906 | Rexroth et al. | 53/216 X |
| 1,337,693 | 4/1920 | Dewey | 53/216 X |
| 1,875,567 | 9/1932 | Daniels | 53/216 X |
| 1,882,695 | 10/1932 | Aldrich et al. | 53/372.9 X |
| 2,375,144 | 5/1945 | Stephano et al. | 53/372.9 X |
| 2,627,711 | 2/1953 | Dixon | 53/372.9 |
| 2,644,282 | 7/1953 | Irvine | 53/372.9 |
| 2,987,861 | 6/1961 | Brook | 53/225 |
| 3,323,273 | 6/1967 | Lee et al. | 53/221 X |
| 4,085,567 | 4/1978 | Putnam, Jr. et al. | 53/225 |

FOREIGN PATENT DOCUMENTS

| | | | |
|---|---|---|---|
| 0544581 | 2/1923 | Fed. Rep. of Germany . | |
| 965022 | 5/1957 | Fed. Rep. of Germany | 53/221 |
| 0051285 | 4/1977 | Japan | 53/216 |
| 0101067 | 10/1923 | Switzerland . | |
| 745779 | 7/1980 | U.S.S.R. | 53/221 |
| 0941244 | 7/1982 | U.S.S.R. | 53/372.9 |
| 279170 | 4/1927 | United Kingdom | 53/226 |
| 0760865 | 11/1956 | United Kingdom . | |

*Primary Examiner*—Lowell A. Larson
*Assistant Examiner*—Daniel Moon
*Attorney, Agent, or Firm*—Cushman, Darby & Cushman

[57] ABSTRACT

In a device for wrapping commodities of discoid shape, having a die by means of which to enfold each commodity initially in a tubular wrapping flush with one face of the discoid and enveloping the peripheral surface, the commodities and their wrappings are provided with rolling movement by a system incorporating wheels and a stationary guide, during the course of which successive folds of the wrapping are engaged and flattened against the top face by a set of fixed teeth.

4 Claims, 2 Drawing Sheets

FIG.3
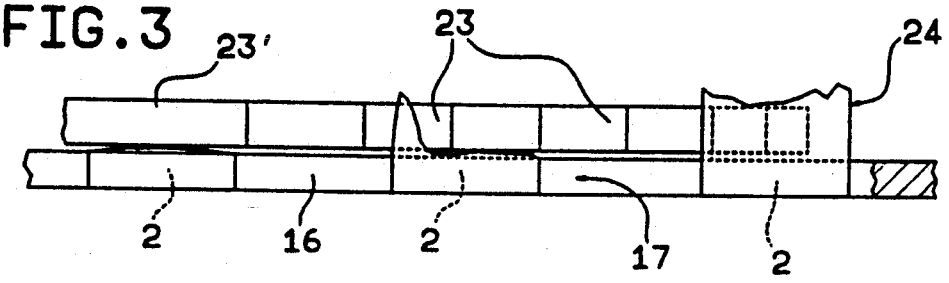
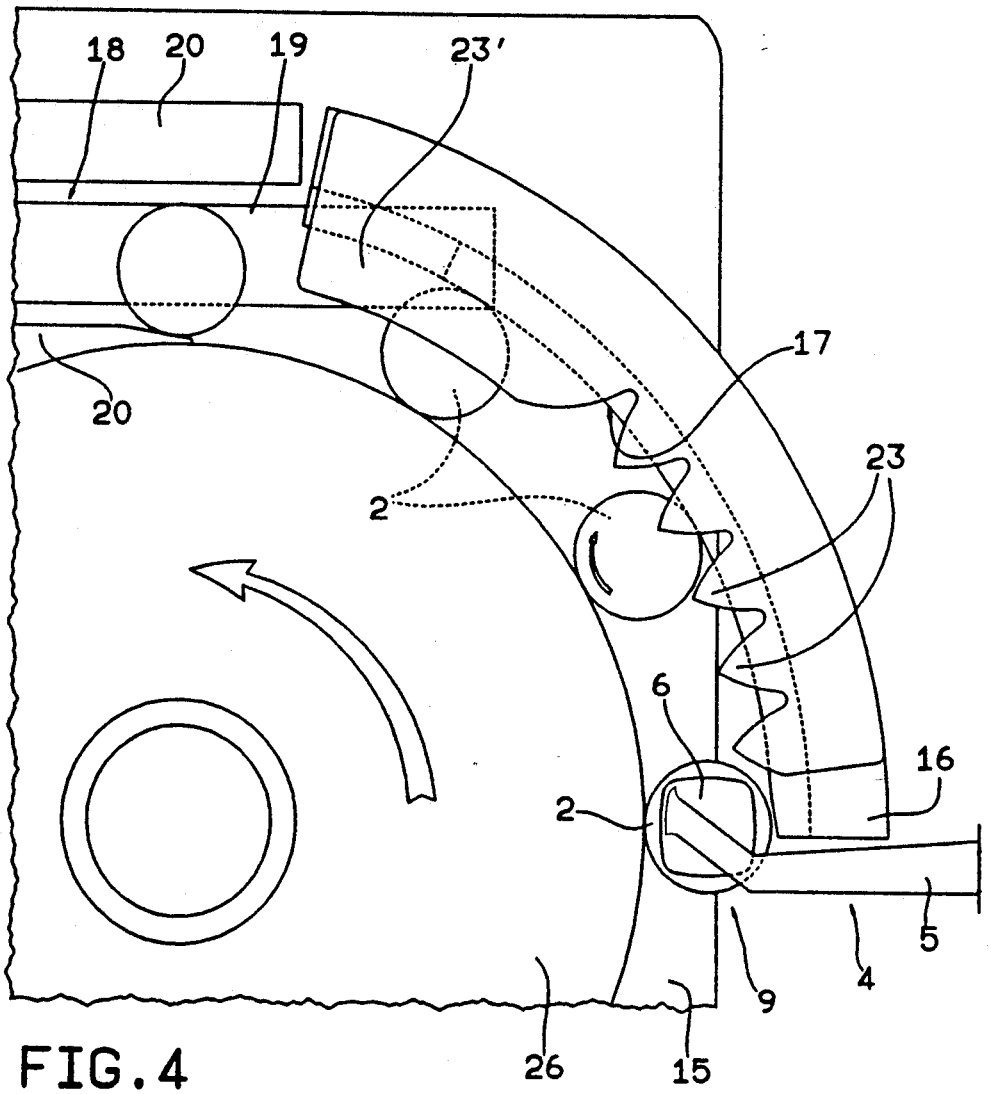
FIG.4

DEVICE FOR WRAPPING DISCOID COMMODITIES

BACKGROUND OF THE INVENTION

The present invention relates to a device for wrapping commodities of discoid shape.

Conventionally, commodities appearing substantially discoid in embodiment are enveloped in a wrapping of suitable material (tin foil, for example) by a method executed in several distinct steps.

Conveyed singly and in succession by intermittently driven means, the commodities are first picked-up individually, together with a leaf of the wrapping material between the jaws of a gripper mechanism; the commodity and the wrapper are transferred thus to a wrapping line, passing through a circular die of diameter substantially identical to that of the commodity.

Passage through the die has the effect of creating a wrapping substantially in the form of a tube, enclosed at one end. The material adheres to one flat face of the commodity and to the periphery, such that an essentially cylindrical shape emerges. The second step of the operation, brought about on the wrapping line, is that of folding the open end of the tubular wrapping against the remaining flat face of the commodity. This is effected by means of a plurality of folders provided with reciprocating movement, which are operated in sequence to flatten successive portions of the wrapper over the face of the commodity, the latter remaining stationary. The operation is brought to completion by smoothing the wrapping over the cylindrical side face of the commodity in such a way as to eliminate the creases produced by the previous folding steps. This final step is accomplished by directing the commodities along a channel having a width which is substantially identical to their own diameter; the walls of the channel are provided by the opposed faces of two counterrotating belt loops, such that the commodities are caused to turn about their axes and each wrapping is pressed flat against the relative cylindrical face.

Wrapping devices of the type outlined above are both complex and costly, due in particular to their incorporating a plurality of power-driven folders by means of which to flatten the wrapper edges. These same folding means, moreover, and the means by which the folded wrapper is smoothed against the cylindrical surfaces of the commodities, tend to impose definite limitations on the operating speed of the wrapping machine into which the device is integrated.

SUMMARY OF THE INVENTION

An object of the present invention is to provide a device for wrapping commodities of substantially discoid shape in which all the drawbacks mentioned above can be overcome. More especially, an object of the invention is to provide a device affording greater economy than prior art embodiments, which imposes no limitation on operating speed, even in the most recent of machines utilized for wrapping commodities of the type in question.

The stated objects are fully realized in a device for wrapping substantially discoid commodities according to the invention, of the type comprising means by which to fold a leaf of wrapping material around a single commodity in such a manner as to produce a tubular wrapping enclosed at one end, in direct contact with one flat face and with the peripheral surface of the commodity. To advantage, the device disclosed comprises a combination of rolling and fixed guides by which each of the single commodities is taken up together with the respective tubular wrapping and invested with revolving motion, and fixed folders in the form of teeth, by which successive portions of the tubular wrapping are engaged during the revolving movement and flattened against the remaining flat face of the commodity.

BRIEF DESCRIPTION OF THE DRAWINGS

The invention will now be described in detail, by way of example, with the aid of the accompanying drawings, in which:

FIG. 3 shows a further detail of FIG. 1, viewed in elevation;,

FIG. 4 is the plan of an alternative embodiment of the device of FIG. 1, in which certain parts are omitted for greater clarity.

DESCRIPTION OF THE PREFERRED EMBODIMENTS

Figure 1:
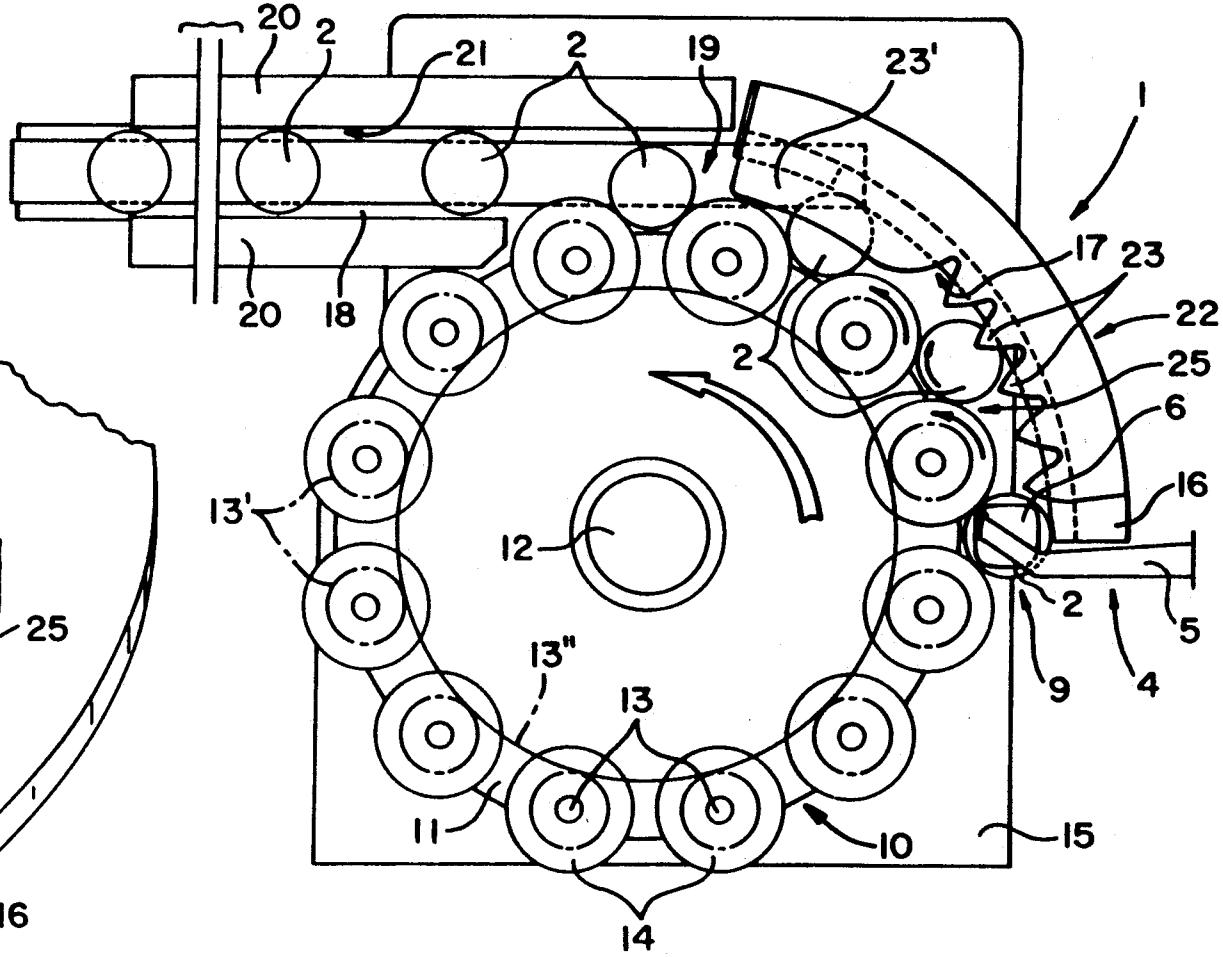
FIG. 1 is the plan view of a device according to the invention for wrapping discoid commodities, with certain parts omitted for greater clarity.
Figure 2:
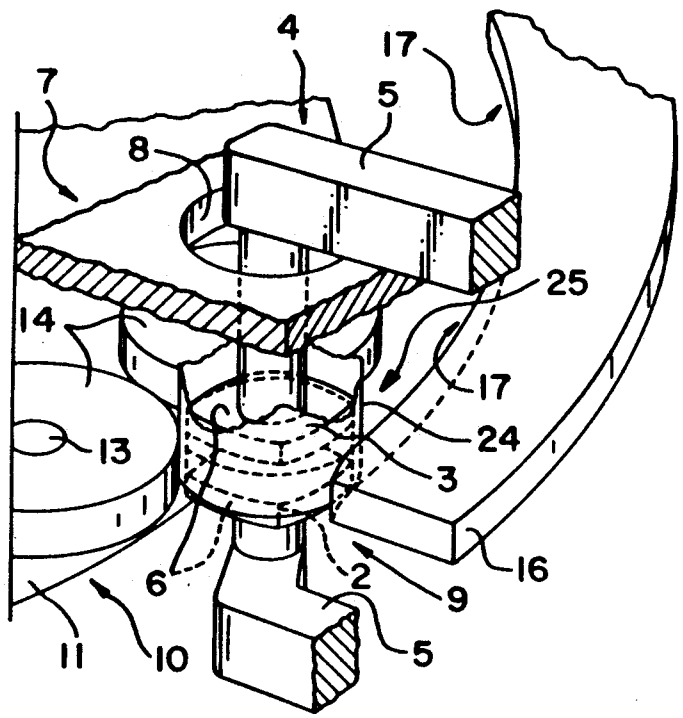
FIG. 2 shows a detail of FIG. 1 in perspective.

With reference to FIGS. 1 and 2 of the drawings, the numeral 1 denotes a device, in its entirety, by means of which to wrap commodities 2 of essentially discoid shape each in a relative leaf (i.e. sheet) of suitable material, or wrapper 3.

The device comprises means embodied as a gripper 4 (see in particular FIG. 2), by which to transfer the single commodities 2 together with their respective wrappers 3 (supplied to the device by means not illustrated) through a substantially vertical path. When in operation, the gripper 4 is provided with translatory motion from a higher position down to a lower position by actuator means (not illustrated); in practical application, such movement might be either rectilinear or curvilinear.

The gripper 4 comprises two jaws 5, of which the ends that enter into contact with the commodity 2 provide respective horizontal plates 6 faced, in a preferred embodiment, with resilient material.

The device comprises first folding means positioned along the vertical path described by the gripper 4 and including a die 7 embodied as a horizontal plate affording a passage or aperture 8 of which the diameter is substantially identical to that of the single commodity 2.

The numeral 9 denotes an entry station located beneath the aperture 8 of the die plate (see FIG. 1), by way of which the commodities 2 are directed onto a rotary conveyor 10 that includes a disk 11 disposed with axis vertical and keyed to a vertical shaft 12 indexed anticlockwise by drive means (not illustrated in the drawings). The periphery of the disk 11 carries a plurality of vertical pivots 13 on the side uppermost, spaced apart at identical distance and carrying respective freely revolving wheels 14, which preferably are faced with resilient material. The numeral 15 denotes a stationary table disposed underneath and adjacent to the bottom surface of the disk 11, which supports rolling means comprising an arcuate guide 16 disposed substantially in the same plane as the wheels 14 and concentric with the disk 11. The guide 16 extends anticlockwise from the entry station 9 through an arc of substantially 90°, and preferably is faced with resilient material on the surface directed toward the rotary conveyor 10. The guide 16, the conveyor 10 and the wheels 14 together constitute means by which to provide the commodities 2 with revolving motion.

The guide 16 and the wheels 14 combine to establish a channel 17 extending from the entry station 9 to the entry end of a belt conveyor 18 (driven by means not illustrated in the drawings) and providing a horizontal conveying surface. The numeral 19 denotes the point, referred to herein as the exit station, at which the belt conveyor 18 lies adjacent to the rotary conveyor 10 and to the guide 16.

The surface of the belt conveyor 18 runs between two horizontal and mutually parallel guides 20, which combine to create a channel 21 substantially constituting a continuation of the channel 17 first mentioned, as will become clear in due course.

With reference to FIG. 3 in particular, the wrapping device comprises further folding means 22 of fixed embodiment, rigidly associated with a stretch of the top surface of the arcuate guide 16 adjacent to the entry station 9, including a plurality of teeth 23 positioned over the channel 17 and spaced uniformly one from the next. The remaining stretch of the top surface of the guide 16, running into the exit station 19, is occupied by a horizontal smoothing plate 23' positioned over the channel 17. In operation, a commodity 2 is directed together with its wrapper 3 in a conventional manner (not described) between the plates 6 of the gripper 4, above the die 7, whereupon the gripper 4 is caused to descend by the actuator means, thus directing the commodity 2 and the associated wrapper 3 down through the aperture 8.

The effect of this downward movement is to gather the wrapper 3 in the manner illustrated in FIG. 2, fashioning a tubular wrapping denoted 24, enclosed at bottom and partly enveloping the commodity 2. Thereupon, with the rotary conveyor 10 momentarily at standstill, the wrapping 24 and the commodity 2 gain the entry station 9 and come to rest on the table 15 internally of a seating 25 created between two adjacent wheels 14 and the arcuate guide 16. The rotary conveyor 10 now indexes. The commodity 2 is taken up in the channel 17, rolling together with the wrapping 24 about its axis by reason of the contact induced between the cylindrical surface and the guide 16. As this same rolling motion continues, the part of the tubular wrapping 24 that projects above the commodity 2 is engaged gradually by the teeth 23 and folded, increment-by-increment onto the upward facing surface of the commodity 2.

At the same time, the lower part of the wrapping 24 is pressed and smoothed against the cylindrical surface of the commodity 2 by the guide 16.

Once the commodity 2 and the wrapper 3 have passed along the part of the channel 17 compassed by the teeth 23 and the operation of folding the tubular wrapping 24 is substantially complete, the fully enveloped commodity 2 passes under the plate 23', still rolling against the guide 16.

The plate 23' extends in the transverse direction substantially to meet the axis of the commodity 2 passing beneath, such that each fold produced by the teeth 23 is flattened, and the top surface of the wrapping 24 smoothed and compacted. Thereafter, the wrapped commodity 2 is transferred through the exit station 19 to the belt conveyor 18, by which it is carried forward to other work stations (not illustrated in the drawings).

In the example of FIG. 4, the wheels 14 are replaced by a single disk 26 disposed concentrically with the guide 16 and set in continuous rotation. Thus, the channel 17 is no longer divided up into single seatings 25 as described above, and the device 1 can receive commodities 2 supplied continuously rather than intermittently to the entry station 9.

In a variant of the device 1 (shown by the phantom lines of FIG. 1), the vertical pivots 13 are mounted freely to the disk 11 and rigidly associated with the relative wheels 14. The device also comprises a plurality of gears 13', one keyed to each of the pivots 13, in mesh with a common gear 13'' mounted coaxially to the vertical shaft 12.

In operation, each time the conveyor 10 is indexed and a commodity 2 with its tubular wrapping 24 thus directed into the channel 17, the commodity 2 will begin turning about its vertical axis by reason of the rolling contact induced, in this instance, not only between the cylindrical surface of the discoid commodity and the guide 16, but also between the cylindrical surface and the wheels 14, which are set in rotation by the meshing contact between the respective gears 13' and the common gear 13''.

It will be clear that the device 1 thus described is particularly simple and economical in embodiment and, in accordance with the objects stated at the outset, able to operate at speeds distinctly higher than those attainable with the conventional types of arrangement mentioned.

What is claimed is:

1. Apparatus for wrapping a sheet of wrapping material against one flat end of each of a succession of partially wrapped discoidal commodities each already having a sheet of wrapping material peripherally wrapped around a peripheral sidewall thereof and generally flatwise against an opposite flat end thereof so as to have a portion of said sheet of wrapping materially tubularly coaxially extending beyond said one flat end of each said commodity, said apparatus comprising:

a plurality of fixed folding elements arranged in succession along a path; and means for rollingly conveying said partially wrapped discoidal commodities in succession along said path, while rotating each said partially wrapped discoidal commodity about a respective longitudinal axis thereof so as to successively bring angularly successive increments of said portion of the respective said sheet of wrapping material into contact with respectively successive ones of said fixed folding elements for folding said portion of the respective sheet flatwise against the respective said one flat end on each respective discoidal commodity;

a support surface arranged for engaging and maintaining each said sheet of wrapping material flatwise against the respective opposite end of each said partially wrapped discoidal commodity while said tubularly extending portion of the respective said sheet of wrapping material is being flattened against the respective one end of each said partially wrapped discoidal commodity;

said rollingly conveying means defining an arcuate channel along which said partially wrapped discoidal commodities are conveyed in succession by simultaneous direct engagement of the sheet of wrapping material against the peripheral sidewall of each partially wrapped discoidal commodity on laterally opposite sides of said channel by a radially inner movable surface and a radially outer fixed guide, said inner movable surface being provided by an outer peripheral surface of a single rotary disk engaging said succession of commodities and which rotates about its own longitudinal axis while so engaged with the respective said partially wrapped discoidal commodity; and said plurality of fixed folding elements comprising a respective plurality of teeth which extend into intersecting relation with successive increments of said portions of said sheets of wrapping material as said partially wrapped discoidal commodities are successively rollingly conveyed along said channel.

2. The apparatus of claim 1, wherein: said rotary disk is power-driven.

3. The apparatus of claim 1, wherein:

said means for rollingly conveying is arranged for rollingly conveying said partially wrapped discoidal commodities along said path with said longitudinal axes of said discoidal commodities oriented vertically; and further including:

upwardly facing support surface means delimiting said path from below; and said path being delimited from above along a first portion thereof by said fixed folding elements, and along a second, subsequent portion thereof by a downwardly facing smoothing plate for smoothing engagement with said portions of said respective sheets after said portions have been folded flatwise against said one ends by said fixed folding elements.

4. Apparatus for wrapping a sheet of wrapping material against one flat end of each of a succession of partially wrapped discoidal commodities each already having a sheet of wrapping material peripherally wrapped around a peripheral sidewall thereof and generally flatwise against an opposite flat end thereof so as to have a portion of said sheet of wrapping materially tubularly coaxially extending beyond said one flat end of each said commodity, said apparatus comprising:

a plurality of fixed folding elements arranged in succession along a path; and means for rollingly conveying said partially wrapped discoidal commodities in succession along said path, while rotating each said partially wrapped discoidal commodity about a respective longitudinal axis thereof so as to successively bring angularly successive increments of said portion of the respective said sheet of wrapping material into contact with respectively successive ones of said fixed folding elements for folding said portion of the respective sheet flatwise against the respective said one flat end on each respective discoidal commodity;

a support surface arranged for engaging and maintaining each said sheet of wrapping material flatwise against the respective opposite end of each said partially wrapped discoidal commodity while said tubularly extending portion of the respective said sheet of wrapping material is being flattened against the respective one end of each said partially wrapped discoidal commodity;

said rollingly conveying means defining an arcuate channel along which said partially wrapped discoidal commodities are conveyed in succession by simultaneous direct engagement of the sheet of wrapping material against the peripheral sidewall of each partially wrapped discoidal commodity on laterally opposite sides of said channel by a radially inner movable surface means and a radially outer fixed guide, said inner movable surface means being provided by respective outer peripheral surfaces of a plurality rotary disks each of which rotates about its own longitudinal axis while so engaged with the respective said partially wrapped discoidal commodity, the longitudinal axes of said rotary disks being arranged in a circle, with equiangular spacing between them around said circle; and said plurality of fixed folding elements comprising a respective plurality of teeth which extend into intersecting relation with successive increments of said portions of said sheets of wrapping material as said partially wrapped discoidal commodities are successively rollingly conveyed along said channel;

wherein said means for rollingly conveying is arranged for rollingly conveying said partially wrapped discoidal commodities along said path with said longitudinal axes oriented vertically;

further including upwardly facing support surface means delimiting said path from below; and said path being delimited from above along a first portion thereof by said fixed folding elements, and along a second, subsequent portion thereof by a downwardly facing smoothing plate for smoothing engagement with said portions of said respective sheets after said portions have been folded flatwise against said one ends by said fixed folding elements.

* * * * *